US008236142B2

(12) United States Patent
Westbrook

(10) Patent No.: US 8,236,142 B2
(45) Date of Patent: Aug. 7, 2012

(54) PROCESS FOR TRANSPORTING AND QUENCHING COKE

(75) Inventor: Richard Westbrook, Knoxville, TN (US)

(73) Assignee: Westbrook Thermal Technology, LLC, Knoxville, TN (US)

( * ) Notice: Subject to any disclaimer, the term of this patent is extended or adjusted under 35 U.S.C. 154(b) by 211 days.

(21) Appl. No.: 12/783,225

(22) Filed: May 19, 2010

(65) Prior Publication Data

US 2011/0284360 A1 Nov. 24, 2011

(51) Int. Cl.
*C10B 39/00* (2006.01)

(52) U.S. Cl. ..... 201/39

(58) Field of Classification Search ..... 201/39; 202/227, 228, 230, 263
See application file for complete search history.

(56) References Cited

U.S. PATENT DOCUMENTS

| | | | | |
|---|---|---|---|---|
| 1,836,219 | A | 12/1931 | Wright | |
| 2,232,141 | A | 2/1941 | Salden | |
| 3,547,782 | A | 12/1970 | Schon | |
| 3,652,403 | A * | 3/1972 | Knappstein et al. | 201/39 |
| 3,843,460 | A | 10/1974 | Preis | |
| 4,024,023 | A | 5/1977 | Jonnet | |
| 4,053,366 | A | 10/1977 | Holter | |
| 4,886,580 | A | 12/1989 | Kress et al. | |
| 4,997,527 | A | 3/1991 | Kress et al. | |
| 5,039,379 | A | 8/1991 | Nashan | |
| 5,190,617 | A | 3/1993 | Kress et al. | |
| 5,845,971 | A | 12/1998 | Rogers | |
| 6,192,804 | B1 | 2/2001 | Snead | |
| 7,111,907 | B2 | 9/2006 | Boon | |
| 7,611,609 | B1 * | 11/2009 | Valia et al. | 201/5 |
| 2007/0205091 | A1 | 9/2007 | Barkdoll et al. | |

* cited by examiner

*Primary Examiner* — Jill Warden
*Assistant Examiner* — Joye L Woodard
(74) *Attorney, Agent, or Firm* — Pitts & Lake, P.C.

(57) ABSTRACT

A method and apparatus for transporting and quenching coke, useful in quenching a batch of coke produced in one of a plurality of coke ovens forming a coke oven battery, is disclosed. A hot car defining a substantially planar receiving surface is positioned adjacent a coke oven of the coke oven battery, and a unitary cake of unquenched coke is placed onto the hot car receiving surface. The hot car and unquenched coke are transported to a transfer station having a dust collection system. A quenching car is positioned at the transfer station adjacent the hot car, under the dust collection system. The unitary cake of unquenched coke is dumped into the quenching car receptacle, thereby separating the unitary cake. At least a portion of the dust generated by separation is collected. The quench car is then transported to a quenching station, where the separated coke is quenched.

17 Claims, 14 Drawing Sheets

PROCESS FOR TRANSPORTING AND QUENCHING COKE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to the production of coke from coal. More particularly, this invention pertains to an improved method and apparatus for transporting and quenching hot coke while collecting dust during transportation of the hot coke from a coke production oven through a quenching apparatus.

2. Description of the Related Art

Coke is a solid carbon fuel and carbon source which is typically manufactured from coal and is used in numerous applications, for example, to melt and reduce iron ore in the production of steel. Coke ovens have been used for many years to convert coal into coke in a process known generally as "coking." During the coking process, finely crushed coal is heated under controlled temperature conditions to devolatilize the coal and form a fused mass of coke known as a "cake" having a predetermined porosity and strength. In one known process, coke used for refining metal ores is produced by batch feeding pulverized coal into an oven which is sealed and heated to high temperatures under closely controlled atmospheric conditions. Once a batch of coal is heated into caked coke, the coke is pushed from the coke oven and transported to a quenching apparatus, where the coke is quenched with water. Thereafter, the quenched coke may be screened and loaded onto suitable transportation devices for shipment to an end user. Because the production of coke is a batch process, multiple coke ovens are typically operated simultaneously in a configuration known as a "coke oven battery."

One of the problems associated with the coke making process is maintaining safety and coordination of the various machines and equipment used in the coke production process. In certain prior art methods for producing coke, the process for transporting hot caked coke from a coke oven to a quenching apparatus to be quenched utilizes four independent heavy machines for assisting an operator in accessing and effecting transportation of the hot caked coke. Specifically, a heavy lifting machine is provided to remove a door on a coke oven to expose an output portal of the coke oven. A separate vehicular machine, referred to as a "hot car," is provided to align with the coke oven output portal, whereupon a ram internal to the coke oven pushes hot caked coke from within the oven onto the hot car. The hot car then transports the received hot caked coke to a stationary ram which pushes the coke from the hot car onto another vehicular machine, called a "quench car." The quench car is adapted to carry the hot coke to a quenching apparatus to be quenched, and thereafter, to dump the quenched coke onto a wharf for further transportation. These machines, when used at the same time, can interfere with one another. For example, the hot car, the stationary ram, and the quench car must each be aligned with one another prior to the stationary ram pushing the hot coke from the hot car onto the quench car. In addition, the door machine can occupy the same space as the hot car, although not normally at the same time. Uncoordinated and/or misaligned use of these machines can result in collision or other such accidents, potentially resulting in spillage of the hot coke batch, injury, and/or equipment damage.

Another problem associated with some heat recovery coke making processes is dusting and pollution associated with transportation of the coke as it is discharged from the coke ovens. In one known process, a hot car is provided for transporting hot coke from a coke oven to a quenching apparatus. In this process, the hot car is positioned tangential to and at an elevation lower than an output portal of the coke oven. Once a charge of coal is converted into hot caked coke within the coke oven, the hot caked coke is pushed from the coke oven through the output portal and allowed to drop onto the hot car, thus allowing the caked coke to separate into smaller pieces of loose bulk coke. As the caked coke drops into the hot car, a significant amount of coke dust and other pollution is generated at the location of the coke oven output portal. In use of a coke oven battery employing numerous coke ovens, this process of discharging hot caked coke from a coke oven into a hot car, and subsequent significant dust and pollution generation, is repeated at the location of each coke oven output portal in the coke oven battery. Thus, not only does the above-described process produce a significant amount of dust and other pollution, but such dust and other pollution is produced and discharged over a large area encompassing each of the coke oven output portals in the coke oven battery. This dust is generally captured with low efficiency by a large shed which covers the entire coke side of the battery including the hot car and related tracks. Dust which is partially captured within the shed may be evacuated through a fabric filter for additional particulate removal. This de-dusting practice is costly, inefficient, and a difficult environment from which to operate with personnel and equipment.

In certain coke oven batteries employing numerous ovens, the coke discharged from the oven falls into a car at each oven and also generates a plume of dust and other pollutants. The typical control device in this case is a traveling hood which can move over the entire battery and be positioned at the oven being pushed. The hood discharges into a duct which is used in conjunction with a fabric filter for dust removal. This technique, although effective, is costly and difficult to maintain.

In another process, a hot car having a planar receiving surface is positioned tangential to and at an elevation equal to the base of the output portal of the coke oven. In this process, hot coke is pushed from the coke oven through the output portal onto the planar receiving surface of the hot car in a unitary slab. The unitary slab of hot coke is transported to a quenching apparatus, where it is quenched prior to separation of the quenched coke into usable pieces. While this process results in less generation of dust near the coke oven output portals than the above-described process, quenching the coke in a unitary slab form rather than loose bulk form results in non-uniform quenching of the coke comprising the unitary slab. Furthermore, coke quenched in a denser, unitary slab form is more difficult to quench uniformly than coke which is quenched in loose bulk form.

Another transportation and quenching method used previously in non recovery and heat recovery coke making applications utilizes only one car which removes the oven door and aligns the coke car for receiving a unitary slab. The hot coke is transferred to the car, transported along a set of tracks to a quenching apparatus, and quenched as a unitary slab in the car. However, the occupation of the single car by a single coke batch through the entire process of unloading the coke oven, transporting, and quenching the coke results in increased cycle time between oven discharges. Furthermore, this type of car is typically uncovered and permits an undesirable amount of fugitive emissions during transport. This type of combination hot car and quench car must typically also travel along its tracks to the quench tower and wharf where coke is quenched and side-dumped from the car onto a wharf. In doing so, the car must stop precisely at an end location along its tracks to avoid over running the tracks which terminate at the wharf. Such precise car movements are therefore slower and increase the chances for a hard stop at the track's end.

In light of the above, there is need for improved methods for transporting and quenching hot coke which allow for short cycle times between oven pushes, the separation of hot caked coke into loose bulk coke prior to quenching, and also cost effective collection of dust generated during the separation process. There is also need for improved methods for transporting and quenching hot coke which utilize a minimum number of mobile machines which are configured such that the machines may not interfere with one another during normal operation.

BRIEF SUMMARY OF THE INVENTION

A method and apparatus for transporting and quenching a batch of coke produced in one of a plurality of coke ovens forming a coke oven battery is disclosed. An apparatus for transporting and quenching coke includes a first railway extending between each coke oven in the coke oven battery and a transfer station. A hot car is provided to travel along the first railway to transport a batch of hot caked coke from one of a plurality of coke ovens forming the coke oven battery to the transfer station. The hot car transports the coke within an enclosed container to minimize fugitive dust emissions. At the transfer station, a quench car is provided having a receptacle with an open upper portion sized to receive therein a batch of hot coke dumped from above. The quench car is positioned at an elevation such that a bottom surface of the quench car receptacle is substantially below the elevation of the hot car receiving surface. The hot caked coke is tilted and dumped from the hot car to the quench car, during which separation of the hot caked coke into loose bulk coke occurs.

The transfer station is provided with a stationary dust collection system for collecting dust generated proximate the transfer station during transfer of the hot caked coke to the quench car and resultant separation of the hot caked coke. In one embodiment, a dust collection hood is provided in fluid communication with a filtration device via a collection duct. The dust collection hood is positioned over the transfer station, and the filtration device includes an impeller for driving dust-laden air from under the dust collection hood, through the collection duct, and to the filtration device for separation of the dust from the air.

The quench car is configured to travel along a second railway to transport the loose bulk coke to a quenching apparatus for quenching. In one embodiment, a tower is provided to support a plurality of sprays for directing water onto the coke, thereby quenching the coke. In another embodiment, a lift is provided for positioning the receptacle at an upper end of a dry quench apparatus and dumping the receptacle into a receiver of the dry quench apparatus. Following quenching of the coke, the coke is directed to a staging area for storage and eventual transportation to an end user.

In one embodiment of the method of the present invention, a batch of hot caked coke is loaded onto the hot car. Thereafter, the coke-laden hot car is transported to the transfer station. The quench car is positioned at the transfer station, and the coke is dumped from the hot car to the quench car, during which the hot caked coke is separated into loose bulk coke, and dust is generated. The dust is collected using the dust collection system. The coke-laden quench car is then transported to the quenching apparatus, where the coke is quenched. During the quenching process, the hot car may return to the next oven available for pushing. These concurrent actions help minimize the production time of the coke battery operation.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
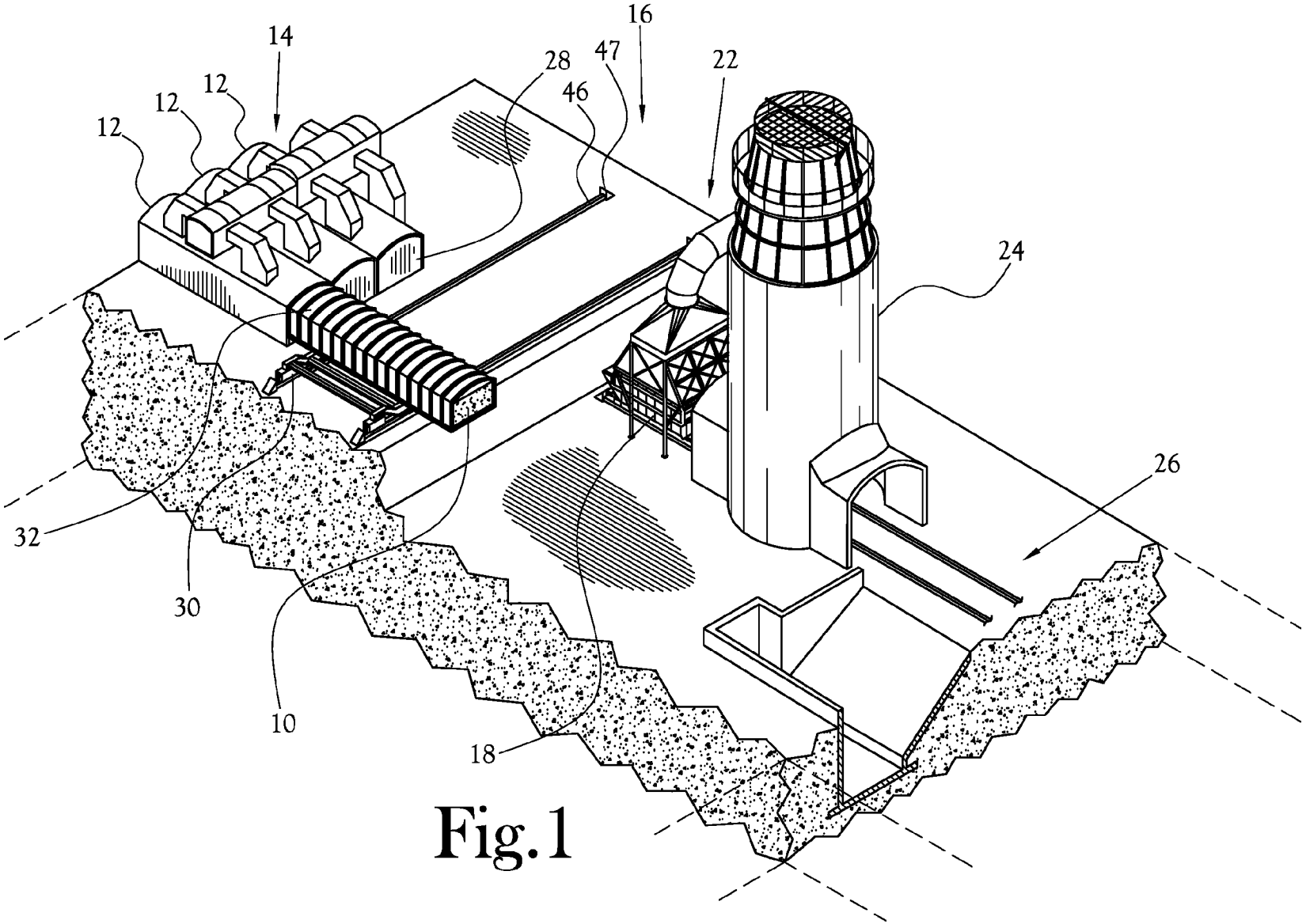
FIG. 1 is a perspective view of one embodiment of an apparatus for transporting and quenching coke of the present invention, showing the hot car positioned at the coke oven battery.

A method and apparatus for transporting and quenching a batch of coke produced in one of a plurality of coke ovens forming a coke oven battery is disclosed and described herein and in the accompanying Figures. With reference to FIG. 1, the method for transporting and quenching coke, or method, utilizes a hot car 32 to transport a batch of hot caked coke 10 from one of a plurality of coke ovens 12 forming a coke oven battery 14 to a transfer station 16. At the transfer station 16, the hot caked coke 10 is transferred to a quench car 18, during which separation of the hot caked coke 10 into loose bulk coke 20 occurs (see FIG. 4). As will be further explained below, the transfer station 16 is provided with a dust collection system 22 for collecting dust generated proximate the transfer station 16 during transfer of the hot caked coke 10 to the quench car 18 and resultant separation of the hot caked coke 10. The quench car 18 is used to transport the loose bulk coke 20 to a quenching apparatus 24 for quenching and thereafter to a staging area 26 for storage and eventual transportation to an end user.

Referring to FIG. 1, there is illustrated a perspective view of a typical coke oven battery 14 and associated apparatus for transporting and quenching a batch of hot caked coke 10 in accordance with the present invention. The coke oven battery 14 includes a plurality of coke ovens 12 arranged in a side by side configuration along a longitudinal dimension of the coke ovens 12. Each of the coke ovens 12 defines an output portal 28 allowing access to an interior of the coke oven 12 and removal of a batch of hot caked coke 10 therefrom. In the illustrated embodiment, the coke oven battery 14 is configured such that each output portal 28 is aligned adjacent a first railway 30 in a substantially linear configuration. The first railway 30 extends between each coke oven output portal 28 and a transfer station 16. A hot car 32 is provided to travel along the first railway 30, thereby traversing perpendicularly to the longitudinal dimension of the coke ovens 12 such that the hot car 32 is movably repositionable between the transfer station 16 and a position adjacent each output portal 28 for transportation of hot caked coke from each output portal 28 to the transfer station.

Figure 2:
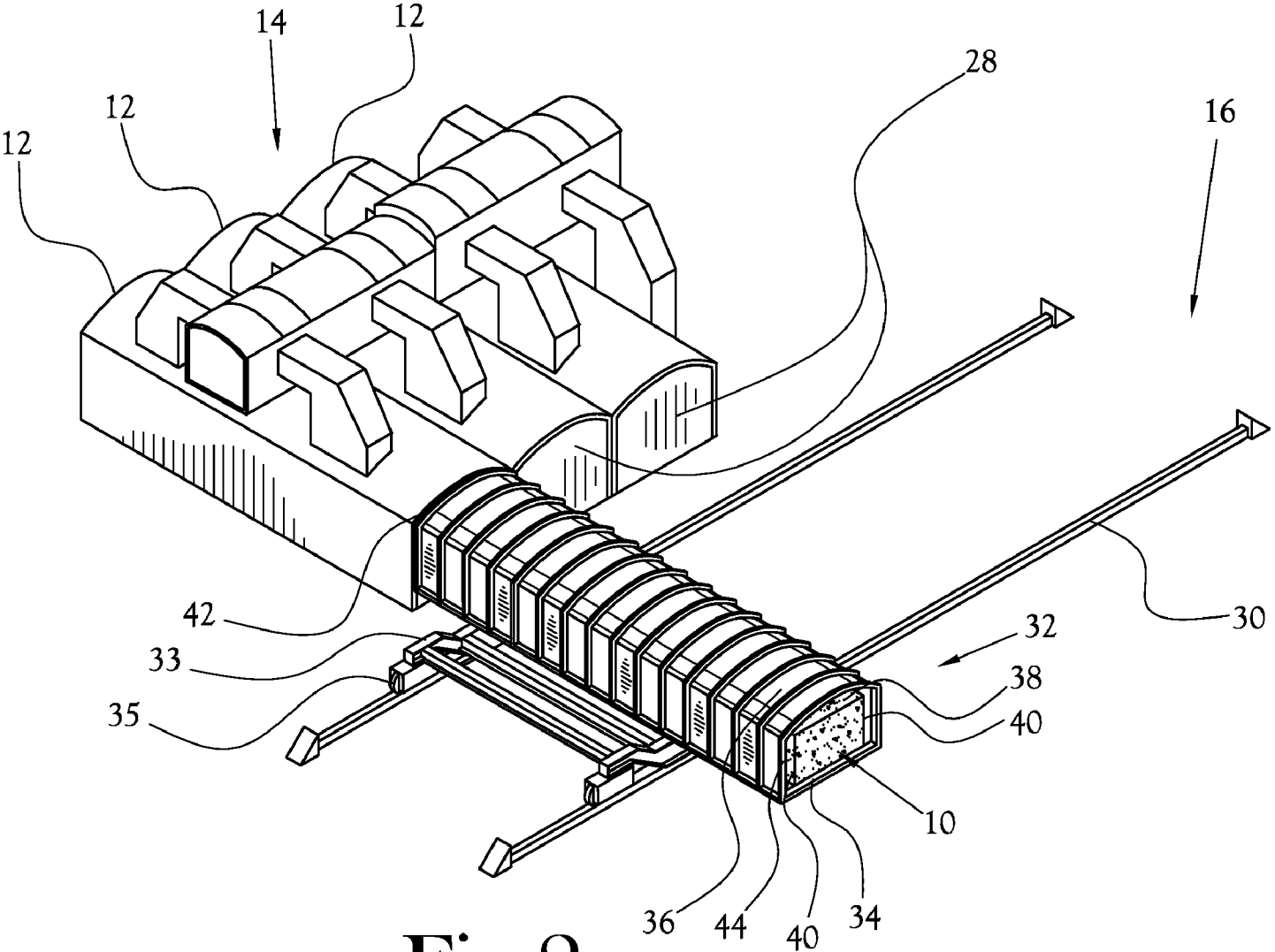
FIG. 2 is a perspective view showing the coke oven battery, first railway, and hot car of the apparatus of FIG. 1.

Referring to FIG. 2, the hot car 32 defines a substantially planar surface 34 adapted to receive a batch of hot caked coke 10 thereon. The surface 34 is carried by a chassis 33 and a suitable wheel structure 35 adapted to allow the hot car 32 to travel along the first railway 30 between the transfer station 16 and each output portal 28. The hot car 32 further defines suitable apparatus (not shown) for removing a door of a coke oven 12 to expose the output portal 28. In the illustrated embodiment, a cover 36 is provided above the surface 34 and is sized to substantially surround a top portion 38 and opposite side portions 40 of a batch of hot caked coke 10 positioned on the surface 34. In the illustrated embodiment, a receiving end 42 and an opposite discharge end 44 of the hot car 32 are open. In another embodiment (not shown), the cover 36 includes doors provided on respective ends 42, 44 of the hot car to substantially enclose the batch of hot caked coke 10 within the hot car 32 while the hot caked coke 10 is carried by the hot car surface 34 in order to limit minor dust emissions from within the hot car 32.

As mentioned above, and with reference to FIGS. 2 and 3, the hot car 32 is adapted to carry a batch of hot coke 10 within the cover 36 on the receiving surface 34 to the transfer station 16. It will be understood by one of skill in the art that the batch of hot caked coke 10 may begin to combust almost immediately upon being discharged from a coke oven 12 at high temperatures and upon being exposed to oxygen in the environment. Thus, in this embodiment, enclosure of the hot caked coke 10 by the cover 36 assists in limiting combustion of the hot caked coke 10, as well as limiting projection of dust, gasses, and other such pollution from the batch of hot caked coke 10 while the hot caked coke 10 is carried by the hot car surface 34 to the transfer station 16. In the illustrated embodiment, the transfer station 16 is located at a terminal end 46 of the first railway 30. Thus, in the illustrated embodiment, alignment of the hot car discharge end 44 with the transfer station 16 is accomplishable by driving the hot car 32 along the first railway 30 to the limit of the first railway terminal end 46. In another embodiment, the transfer station 16 is located at a point along the first railway 30 spaced apart from the terminal end 46. In one embodiment, the hot car discharge end 44 is aligned manually by an operator with the transfer station 16. In another embodiment, the hot car discharge end 44 is aligned with the transfer station 16 using mechanical and electrical means known to one of skill in the art.

Figure 4:
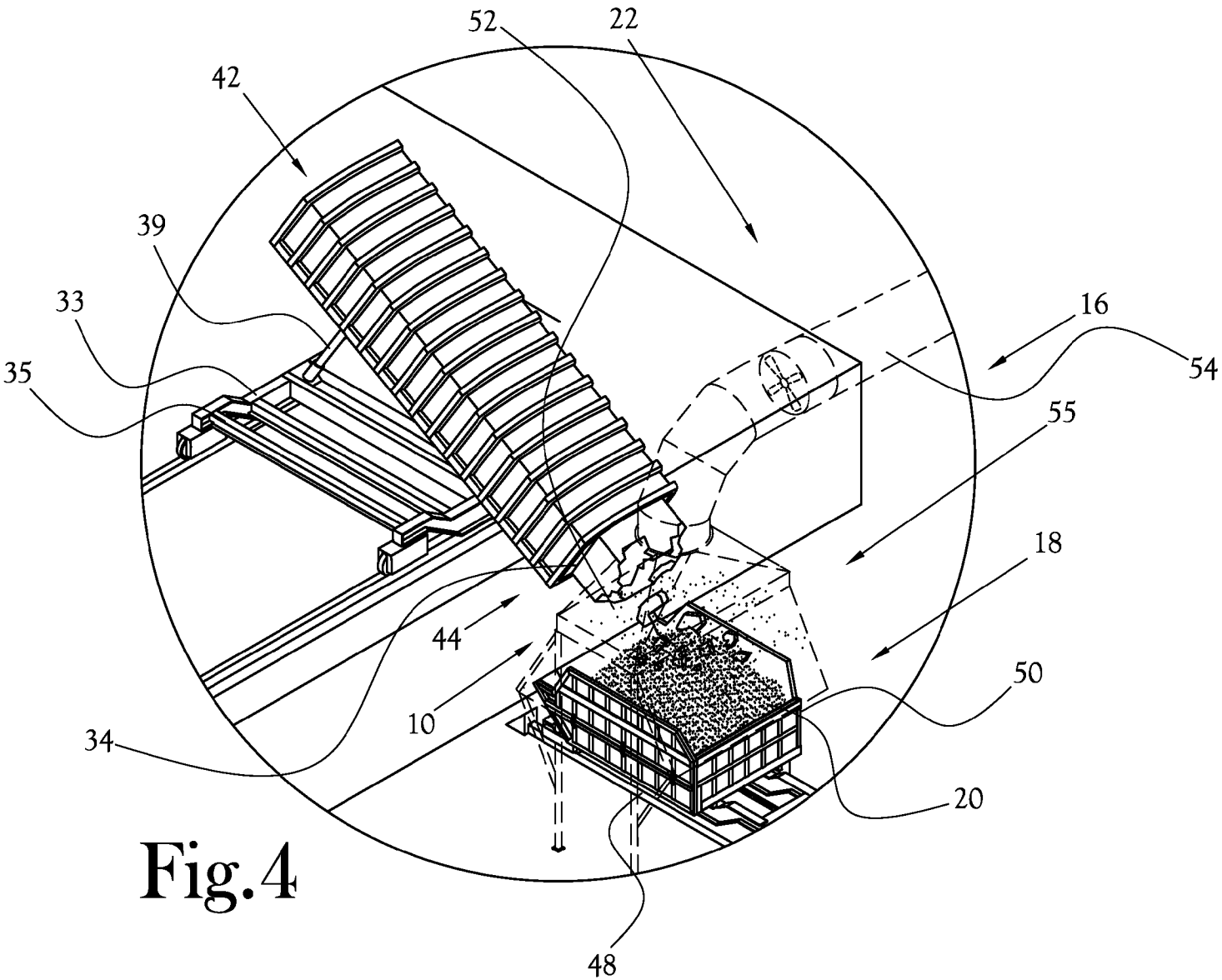
FIG. 4 is a partial perspective view showing the transfer station of FIG. 3, with the hot car inclined to transfer coke to the quench car.

A quench car 18 is provided to travel along a second railway 48 from the transfer station 16 through a quenching apparatus 24. As shown in FIG. 4, the quench car 18 includes a receptacle 50 having an open upper portion sized to receive therein a batch of hot coke 10 dumped from above. The second railway 48 is positioned at an elevation such that a bottom surface of the quench car receptacle 50 is substantially below the elevation of the hot car receiving surface 34. A suitable tilting mechanism 39 interconnects the planar surface 34 of the hot car 32 with the chassis 33 and wheel structure 35 of the hot car 32, such that the receiving end 42 of the hot car 32 can be selectively elevated, thereby tilting the planar surface 34 and the accompanying cover 36 of the hot car 32 toward the discharge end 44 of the hot car 32. In this way, once the hot car discharge end 44 is aligned with the transfer station 16 and the quench car 18 is positioned at the transfer station 16 with the receptacle 50 below the hot car discharge end 44, the hot car 32 is adapted to tilt toward the discharge end 44 to dump the batch of hot caked coke 10 from the hot car discharge end 44 into the quench car receptacle 50.

The difference in elevation between the hot car 32 and the quench car 18 is great enough that dumping the batch of hot caked coke 10 from the hot car 32 to the quench car 18 results in significant separation of the hot caked coke 10, thus dispersing the hot caked coke 10 into loose bulk coke 20. Such separation of the hot caked coke 10 into loose bulk coke 20 assists in uniform quenching of the loose bulk coke 20, as will be discussed below. In one embodiment, as the hot caked coke 10 is transferred from the hot car 32 to the quench car 18, the speed and angle of the tilt of the receptacle 50, as well as the height of the drop between the hot car 32 and the receptacle 50 is selected such that lumps of coke are allowed to separate from the batch of hot caked coke 10 absent significant additional breakage and size degradation of the lumps of coke forming the loose bulk coke 20.

Figure 3:
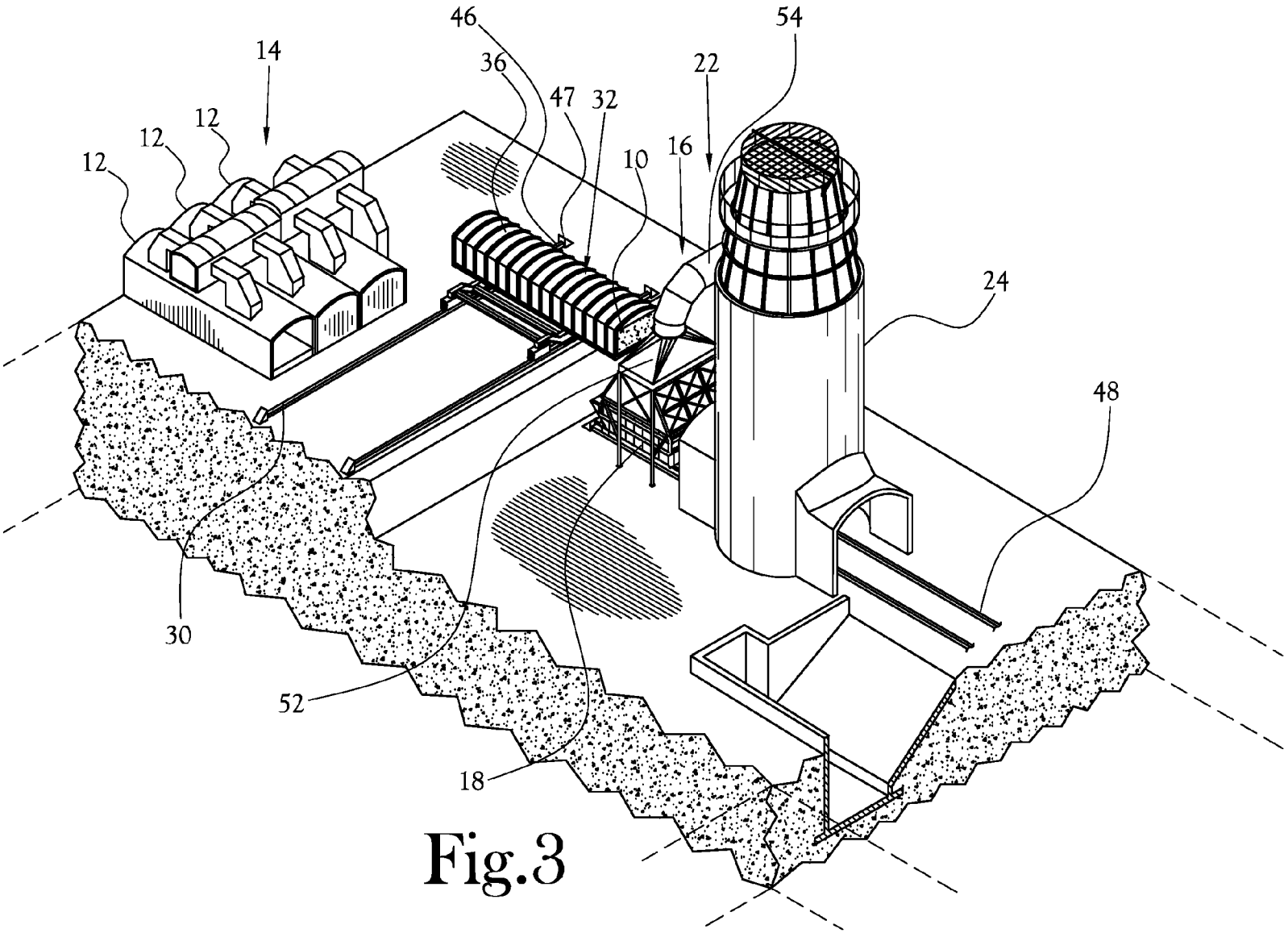
FIG. 3 is a perspective view of the apparatus of FIG. 1, showing the hot car positioned at the transfer station.

It is anticipated that, upon separating the hot caked coke 10 into loose bulk coke 20 during dumping of the hot caked coke 10 from the hot car 32 into the quench car 18, significant dust and other pollution 55 separates from the coke and is carried into the atmosphere surrounding the transfer station 16. Accordingly, a dust collection system 22 is provided to gather and contain a significant portion of the dust during separation of the hot caked coke 10. Referring to FIG. 3, in one embodiment, the dust collection system 22 includes a dust collection hood 52 positioned above and around the open upper end of the quench car 18 when the quench car 18 is positioned at the transfer station 16. An interior of the dust collection hood 52 is provided in fluid communication with a filtration device (not shown) via a collection duct 54. The filtration device includes an impeller configured to draw at least a portion of the dust and other pollution generated by separating the hot caked coke 10 upward from within the dust collection hood 52, through the collection duct 54, and to the air filtration device, where the air filtration device separates a significant portion of the drawn dust from the ambient air.

Figure 5:
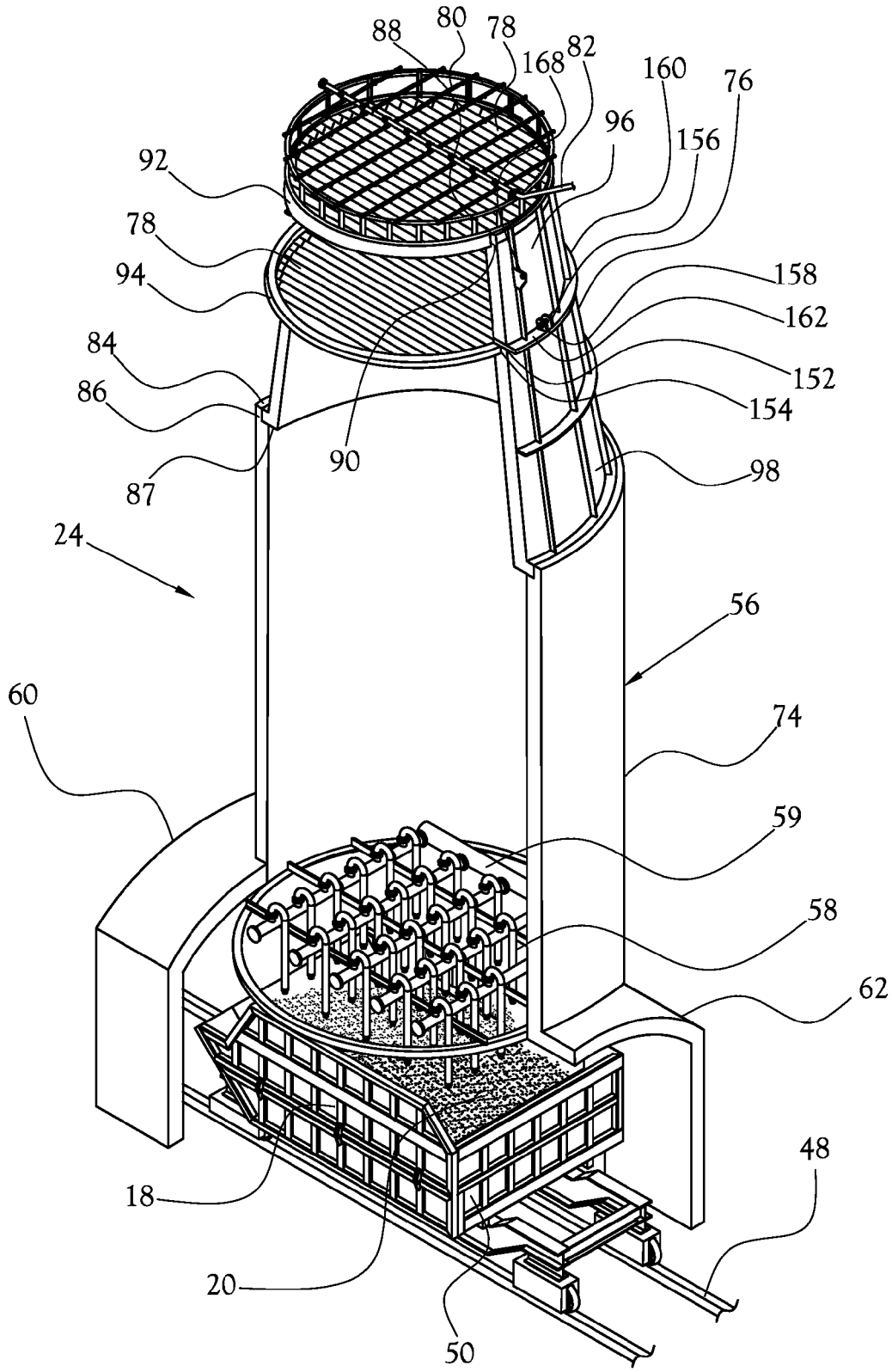
FIG. 5 is a partial cutaway perspective view showing the quenching apparatus of FIG. 1, with the quench car positioned beneath the tower.

Referring to FIG. 5, with the loose bulk coke 20 received within the receptacle 50 of the quench car 18, the quench car 18 is adapted to travel along the second railway 48 to carry the loose bulk coke 20 through a quenching apparatus 24. In the illustrated embodiment, the quenching apparatus 24 is a wet quenching apparatus which includes a tower 56 sized and supported a sufficient distance above the second railway 48 to allow the quench car 18 to travel beneath the tower 56. The tower 56 defines a first portal 60 and an opposite second portal 62 disposed along the second railway 48. Each of the first and second portals 60, 62 is sized to allow the quench car 18 to travel into and out of the interior of the tower 56 through either the first or second portals 60, 62 along the second railway 48. A lower portion 74 of the tower 56 carries and supports a plurality of quenching sprays 58 which are positioned generally above the path of the quench car 18 and configured to face generally downwardly toward the quench car 18 when the quench car 18 is positioned within the tower 56. In the illustrated embodiment, the quenching sprays 58 are in fluid communication with a water supply 59 and are adapted to direct a pre-determined quantity of water onto the hot loose bulk coke 20 sufficient to quench the coke 20.

As water is directed through the quenching sprays 58 onto the hot loose bulk coke 20 to quench the coke, at least a portion of the water is converted into an amount of steam containing particulate matter. This particulate laden steam tends to rise by natural draft through the tower 56. The tower 56 defines an open upper portion 76 having apparatus therein for collecting at least a portion of the particulate laden steam while allowing the remainder of the particulate laden steam to pass from within the tower 56 upward to the atmosphere. The tower upper portion 76 is removably secured to the remainder of the tower 56, such that the tower upper portion 76 is easily removable for maintenance or replacement with a spare unit in one single maintenance shift. In the illustrated embodiment, the tower lower portion 74 defines a generally cylindrical shape having a circular upper edge 84 defining a first annular lip 86. The tower upper portion 76 defines a truncated, frusto-conical shape having a generally circular lower edge 87 sized and shaped to be received within and engaged by the first annular lip 86 of the lower portion 74 to secure the tower upper portion 76 in a stacked position above the tower lower portion 74. A plurality of links 168 are disposed about a periphery of the tower upper portion 76 to allow connection thereto of a crane cable or other suitable lifting apparatus to assist in lifting the tower upper portion 76 from the tower lower portion 74 and lowering the tower upper portion 76 to a ground surface or other suitable work surface, and to assist in replacement of the tower upper portion 76 in the stacked position above the tower lower portion 74.

A plurality of linear baffles 78 are provided for the collection of at least a portion of the particulates and steam. In the illustrated embodiment, an upper edge 88 of the tower upper portion defines a second annular lip 90. A first circular carriage 92 is provided having a size and shape suitable to allow the first carriage 92 to be received within and engaged by the second annular lip 90 to secure the first carriage 92 to the tower upper portion 76 proximate the upper edge 88 of the tower upper portion 76. A plurality of baffles 78 are secured at respective ends thereof to the first carriage 92 and extend in a generally parallel configuration across the open upper end of the tower upper portion 76. Each baffle 78 is configured in a tilted orientation to define a downwardly sloping planar surface so as to allow the particulate laden steam to contact the planar surface of the baffle 78 as the steam rises through the open upper end of the tower 56. The baffles 78 are constructed from a thermally conductive material, such as aluminum, steel, or other thermally conductive material, thus allowing at least a portion of the steam to condense on the baffles 78 upon contacting the baffles 78. Upon condensation of the portion of the steam on the baffles 78, the particulate matter contained within the condensed steam deposits onto the baffles 78.

In certain embodiments, a plurality of carriages 92 having corresponding baffles 78 are provided in a stacked configuration along the elevation of the tower upper portion 76 to allow for greater condensation of the steam and subsequent collection of the particulates along the baffles 78. For example, in the illustrated embodiment, a first carriage 92 carrying a first set of corresponding baffles 78 and a second carriage 94 carrying a second set of corresponding baffles 78 are provided. In this embodiment, the tower upper portion 76 includes a top segment 96 stacked above a bottom segment 98. As discussed above, the top segment 96 defines an upper edge 88 having a second annular lip 90. The first carriage 92 is sized and shaped to be received within and engaged by the second annular lip 90 to secure the first carriage 92 to the top segment 96. The bottom segment 98 has a circular upper edge 152 defining a third annular lip 154. The second carriage 94 is sized and shaped to be received within and engaged by the third annular lip 154 to secure the second carriage 94 to the bottom segment 98. The upper edge 152 of the bottom segment 98 further defines a first flange 158 extending outwardly therefrom. A bottom edge 160 of the top segment 96 defines a second flange 162 sized to mate with the first flange 158 to secure the top segment 96 in a stacked configuration above the bottom segment 98. The top and bottom segments 96, 98 cooperate to define suitable connectors 156 to allow the top and bottom segments 96, 98 to be removably secured to one another.

A plurality of washing sprays 80 are provided to periodically wash excessive buildup of particulate deposits from the baffles 78. In the illustrated embodiment, the washing sprays 80 are configured in an array above the baffles 78 and are directed generally downwardly toward the baffles 78. A water source 82 supplies water to each of the washing sprays 80. At least one valve (not shown) is provided to control water flow through the washing sprays 80, such that the washing sprays 80 are selectively activated to direct water from the water source 82 onto the baffles 78. The water directed from the water source 82 onto the baffles 78 removes at least a portion of the excessive buildup of particulate deposits from the baffles 78, and thereafter the particulate laden water is allowed to fall from the baffles 78 to a lower portion of the tower 56.

Figure 6:
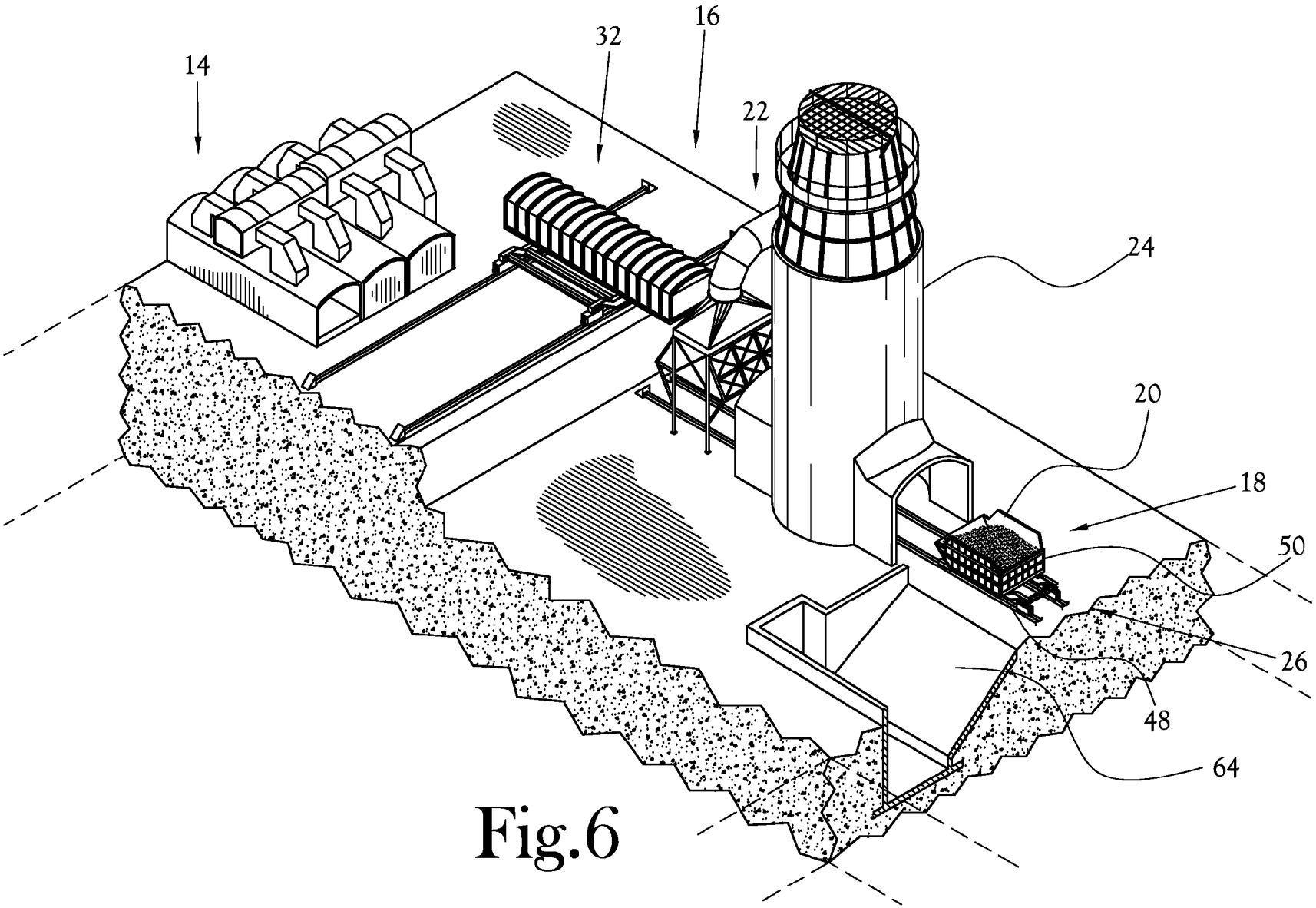
FIG. 6 is a is a perspective view of the apparatus of FIG. 1, showing the quench car positioned at the staging area.

As shown in FIG. 6, after the coke 20 is quenched by the sprays 58, the quench car 18 is adapted to continue along the second railway 48 out from beneath the quenching apparatus 24 and to a staging area 26. The staging area 26 is an area along the second railway 48 sufficiently removed from both the quenching apparatus 24 and the transfer station 16 that the quenched loose bulk coke 20 can be safely unloaded from the receptacle 50 and further transported for storage or use. In the illustrated embodiment, a coke wharf 64 is positioned adjacent the staging area 26. The coke wharf 64 is configured to receive the quenched loose bulk coke 20 and to direct the quenched loose bulk coke 20 to an elevation below the elevation of the quench car 18 and toward a suitable conveyance for further transportation or use.

Figure 7:
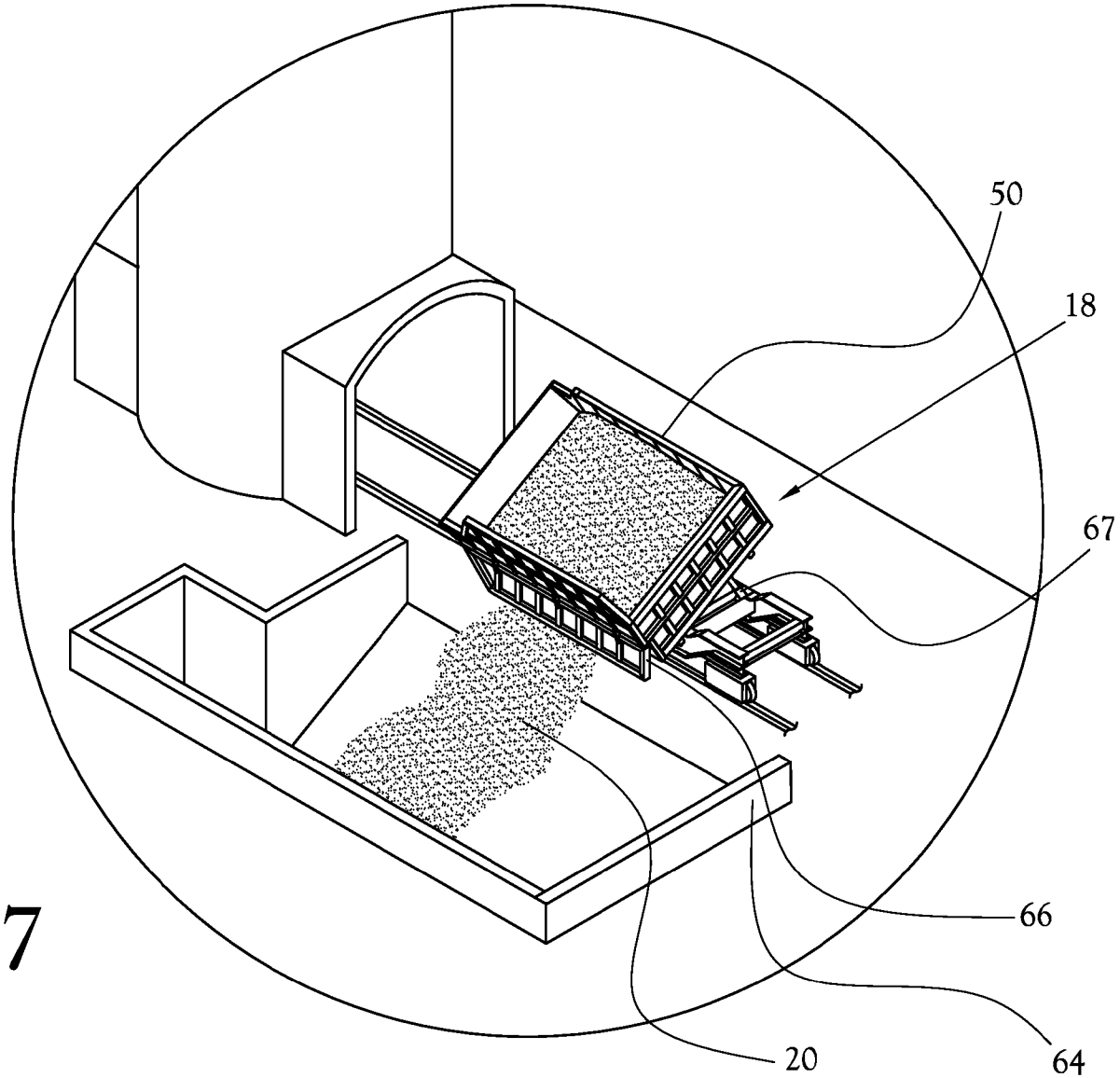
FIG. 7 is a partial perspective view showing the staging area of FIG. 6, with the quench car inclined to transfer the quenched coke to the wharf.

As shown in FIG. 7, the quench car 18 includes apparatus for unloading the quenched coke 20 from the receptacle 50 and onto the coke wharf 64. Specifically, a side wall of the receptacle 50 adjacent the wharf 64 defines a vertically rotatable panel 66 hinged at upper corners of the panel 66. Similarly to the hot car 32 discussed above, a suitable tilting mechanism 67 interconnects the receptacle 50 with the remainder of the quench car 18 such that an end of the receptacle 50 opposite the panel 66 can be selectively elevated toward the panel 66, thereby tilting the receptacle 50 toward the panel 66. Upon tilting the receptacle 50 toward the panel 66, the panel 66 rotates outwardly from the receptacle 50 to allow dumping of the quenched coke 20 from the quench car receptacle 50 onto the wharf 64.

Figure 8:
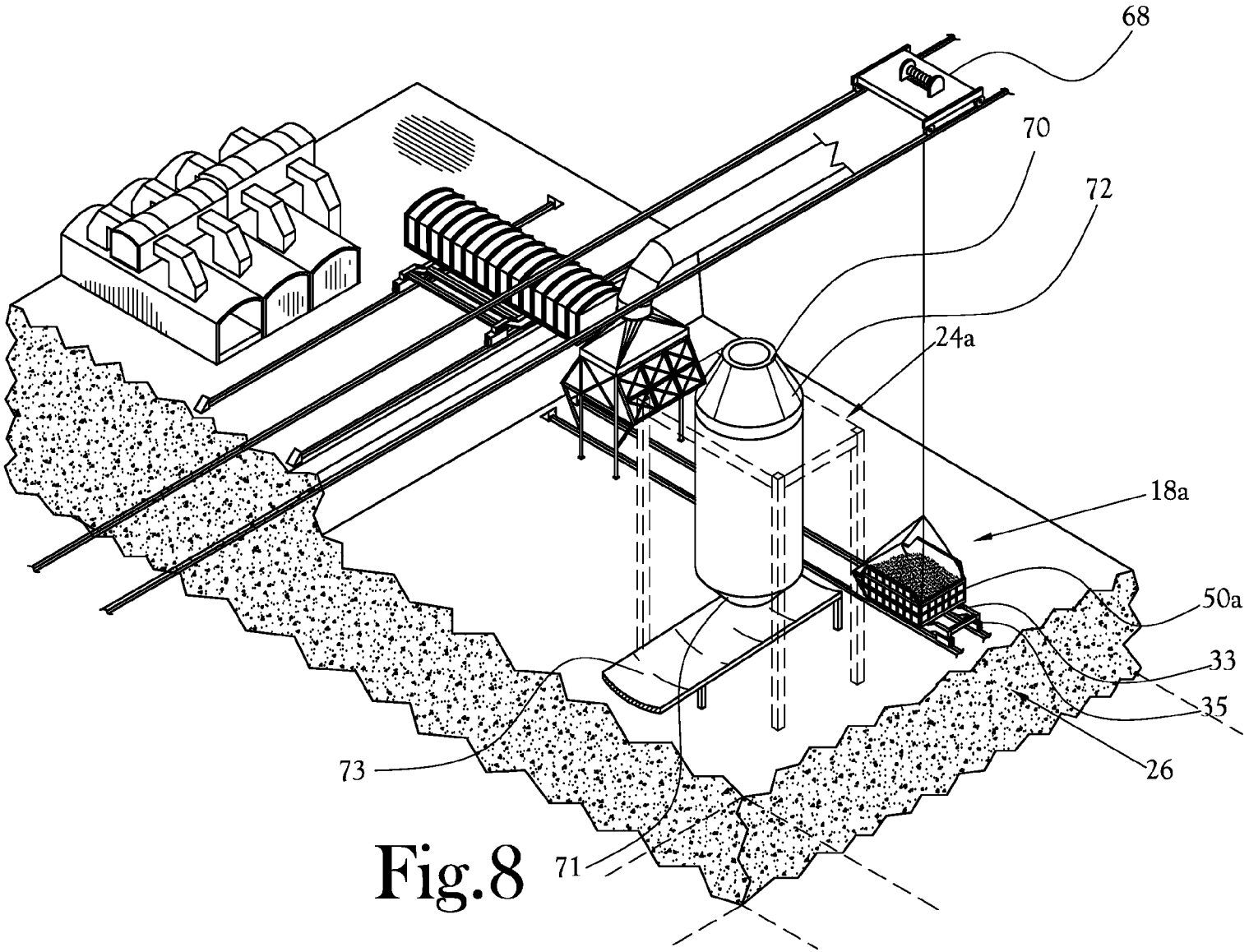
FIG. 8 is a perspective view showing another embodiment of the an apparatus for transporting and quenching coke of the present invention, showing the receptacle hoisted to the receiver of the dry quench apparatus.
Figure 9:
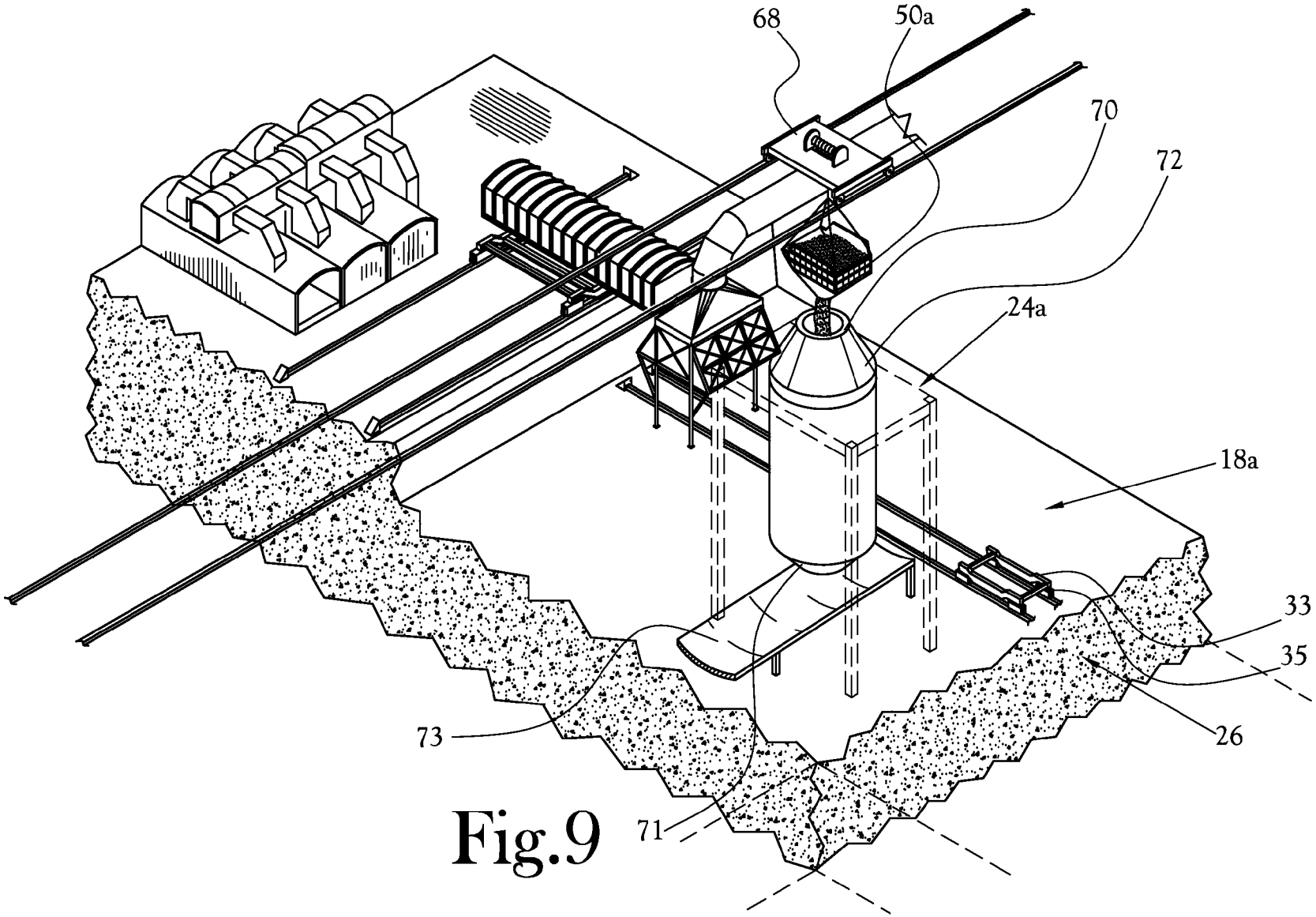
FIG. 9 is a perspective view showing the apparatus of FIG. 8, with the receptacle tilted to dump the coke into the dry quench apparatus.

FIGS. 8 and 9 illustrate another embodiment of the apparatus for transporting and quenching a batch of coke. In the embodiment of FIGS. 8 and 9, the receptacle 50*a* is detachably secured to the chassis 33 and wheel structure 35 of the quench car 18. In this embodiment, the quenching apparatus 24*a* is a dry quenching apparatus which includes a lift 68 adapted to hoist the receptacle 50*a* from the remainder of the quench car 18*a* and carry the receptacle 50*a* to a receiver 70 at an upper end of a dry quench vessel 72. As shown in FIG. 9, once positioned above the receiver 70, the lift 68 is capable of manipulating the receptacle 50*a* to accomplish dumping of the hot loose bulk coke 20 from the receptacle 50*a* into the receiver 70. Thereafter, the lift 68 is configured to return the receptacle 50*a* to the chassis and wheel structure of the quench car 18*a*. The dry quench vessel 72 is of the type known in the art to contain a mechanism for exposing the hot loose bulk coke 20 to a cooler inert gas, thereby quenching the coke 20 with the inert gas before discharging the quenched coke 20 from a bottom end 71 of the dry quench vessel 72. In the illustrated embodiment, the dry quench vessel 72 is positioned above a conveyor 73. Upon discharge of the dry quenched coke 20 from the bottom end 71 of the dry quench vessel 72, the conveyor 73 is adapted to receive the quenched coke 20 thereon and transport the quenched coke to a further location for transportation to an end user.

In each of the above-discussed illustrated embodiments, the receptacle 50 defines a substantially square shape. It will be understood that the substantially square shape of the receptacle 50 enables relatively efficient exposure of the hot loose bulk coke 20 to the quenching apparatus 24. For example, in an embodiment in which a wet quenching apparatus 24 is used, the substantially square shape of the receptacle 50 enables the entire receptacle 50 to fit beneath the tower 56, thereby allowing quenching of an entire batch of hot loose bulk coke 20 all at once. In an embodiment in which a dry quenching apparatus 24*a* is used, the substantially square shape of the detachable receptacle 50*a* enables at least a majority of the receptacle 50*a* to fit above the receiver 70 of the dry quench vessel 72, thereby allowing relatively easy dumping of the hot loose bulk coke 20 from the receptacle 50*a* into the receiver 70. However, it will be understood by one of ordinary skill in the art that a receptacle 50 defining a non-square shape may be used without departing from the spirit and scope of the present invention.

Figure 10:
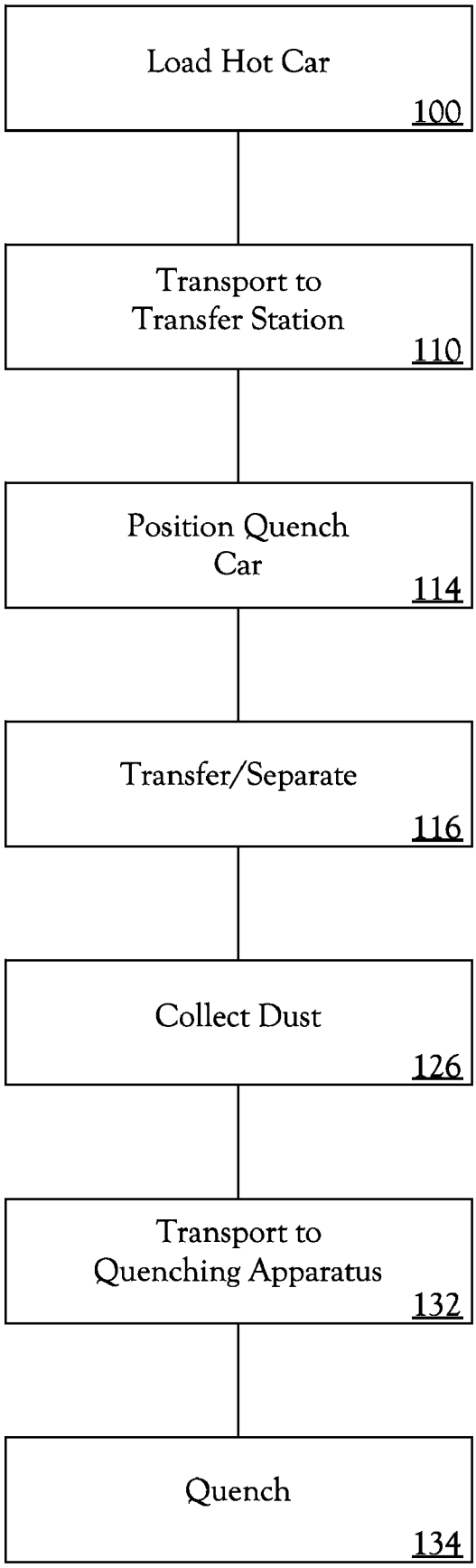
FIG. 10 is a flow diagram showing one embodiment of a method for transporting and quenching coke of the present invention.
Figure 11:
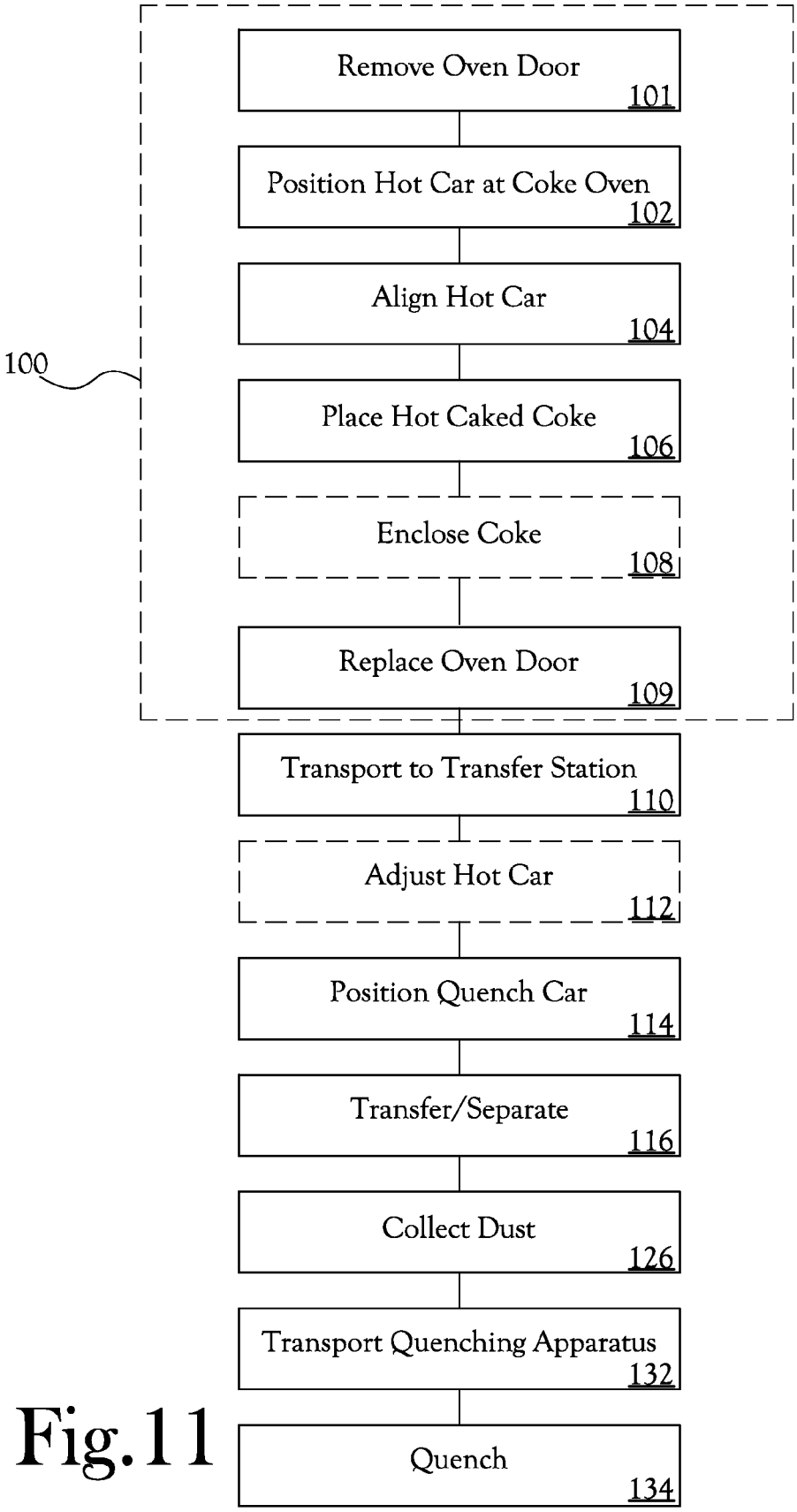
FIG. 11 is a flow diagram showing additional detail of the method of FIG. 10.

With reference now to FIGS. 10-14, various aspects of the method of the present invention will be illustrated and described. As shown in FIG. 10, in an initial step of the method invention, a batch of hot caked coke 10 is loaded 100 onto the hot car 32. As shown in greater detail in FIG. 11, in one embodiment, an oven door is removed 101 to expose an output portal 28 of a coke oven 12. The hot car 32 is moved 102 along the first railway 30 to a position adjacent the output portal 28. Suitable positional adjustment apparatus is provided to align 104 the elevation of the hot car planar surface 34 with a lower boundary of the output portal 28. Once aligned 104 adjacent the open output portal 28, a batch of hot coke 10 is placed 106 on the hot car surface 34 with the cover 36 at least partially surrounding the hot coke 10. In one embodiment, the batch of hot coke 10 comprises a unitary, caked hot coke slab. In an embodiment in which doors are provided on the hot car ends 42, 44, at least the door at the receiving end 42 is opened during placement of the batch of hot coke 10 on the hot car surface 34. Thereafter, the doors are closed 108 to substantially enclose the batch of hot coke 10 within the hot car 32. The coke oven door is then replaced 109 to close the output portal 28 of the coke oven 12.

Following placement 106 and at least partial enclosure 108 of the batch of hot coke 10 on the hot car surface 34, the hot car 32 is driven along the first railway 30 to the transfer station 16, thereby transporting 110 the batch of hot coke 10 to the transfer station 16. In an optional step, adjustment 112 of the position of the hot car 32 along the first railway 30 to align the hot car discharge end 44 with the transfer station 16 is performed. The quench car 18 is then positioned 114 at the transfer station 16 beneath the dust collection hood 52 to receive the coke 10 from the hot car discharge end 44.

Figure 12:
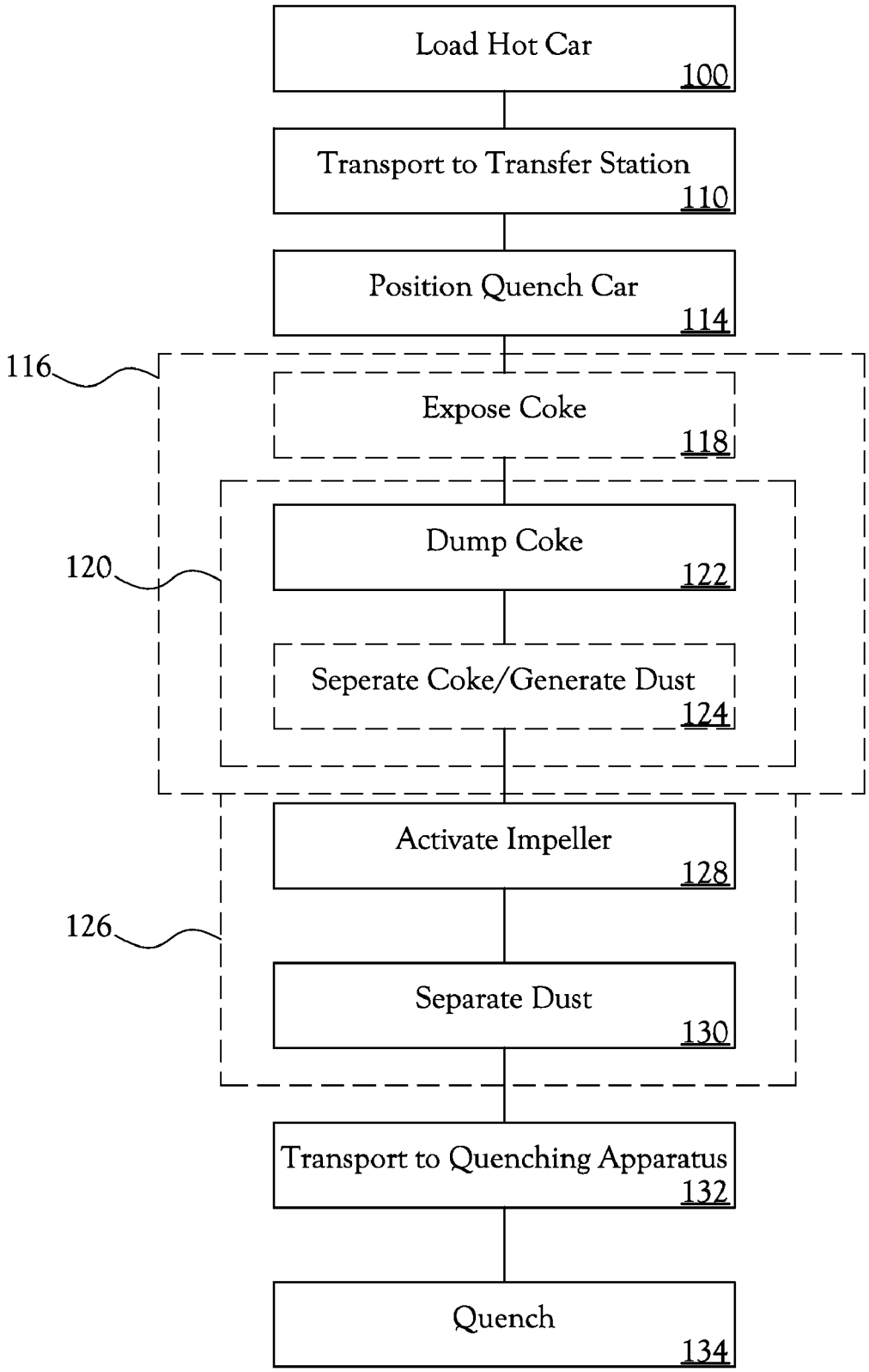
FIG. 12 is a flow diagram showing additional detail of the method of FIG. 10.

With the quench car 18 positioned 114 beneath the dust collection hood 52, transfer 116 of the hot coke 10 from the hot car 32 to the quench car 18 is performed, and separation of the hot caked coke 10 into loose bulk coke 20 occurs as discussed above. Referring to FIG. 12, in an embodiment in which doors are provided on the hot car ends 42, 44, at least the door at the discharge end 44 is opened to expose 118 the batch of hot coke 10, thus allowing release of the batch of hot coke 10 from the discharge end 44. Thereafter, the hot car receiving surface 34 is tilted 120 toward the discharge end 44. As discussed above, tilting 120 of the hot car receiving surface 34 toward the discharge end 44 results both in dumping 122 the batch of hot caked coke 10 from the hot car discharge end 44 into the quench car receptacle 50 and substantial separating 124 of the hot caked coke 10 into loose bulk coke 20.

As discussed above, separation 124 of the hot caked coke 10 into loose bulk coke 20 results in generation of dust or other pollution proximate the transfer station 16. Accordingly, in one embodiment, following separation 124 of the hot caked coke 10 into loose bulk coke 20, a substantial portion of the dust generated during separation is collected 126 by the dust collection system 22. Specifically, the impeller of the filtration system is activated 128, thereby drawing air and dust from the interior of the dust collection hood 52 through the collection duct 54. The filtration system then separates 130 at least a portion of the dust from the drawn air. Thereafter, the quench car 18 is driven along the second railway 48 to the quenching apparatus 24, thereby transporting 132 the hot loose bulk coke 20 to the quenching apparatus 24 to be quenched 134.

Figure 13:
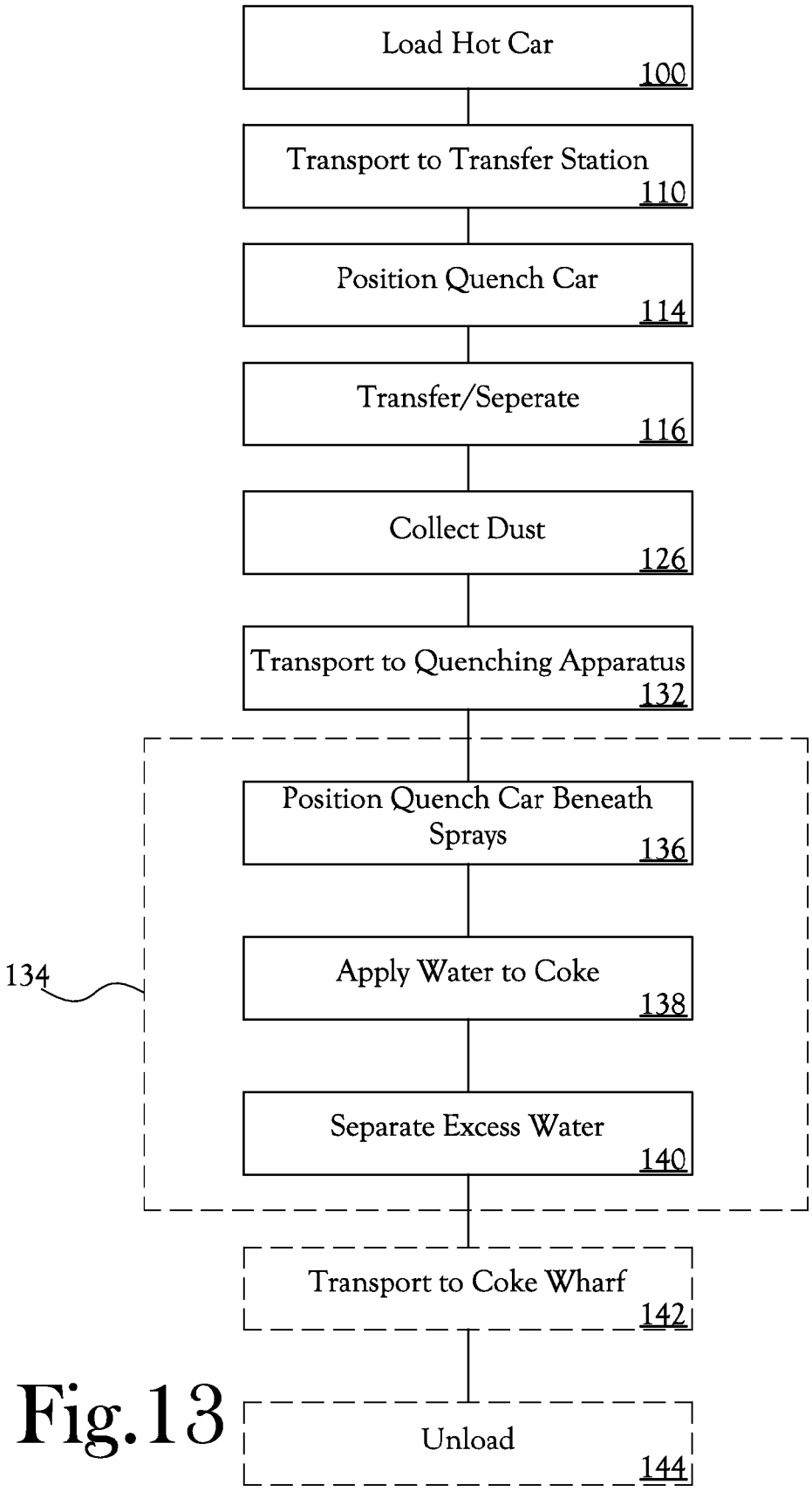
FIG. 13 is a flow diagram showing additional detail of the quenching process in one embodiment of the method invention.
Figure 14:
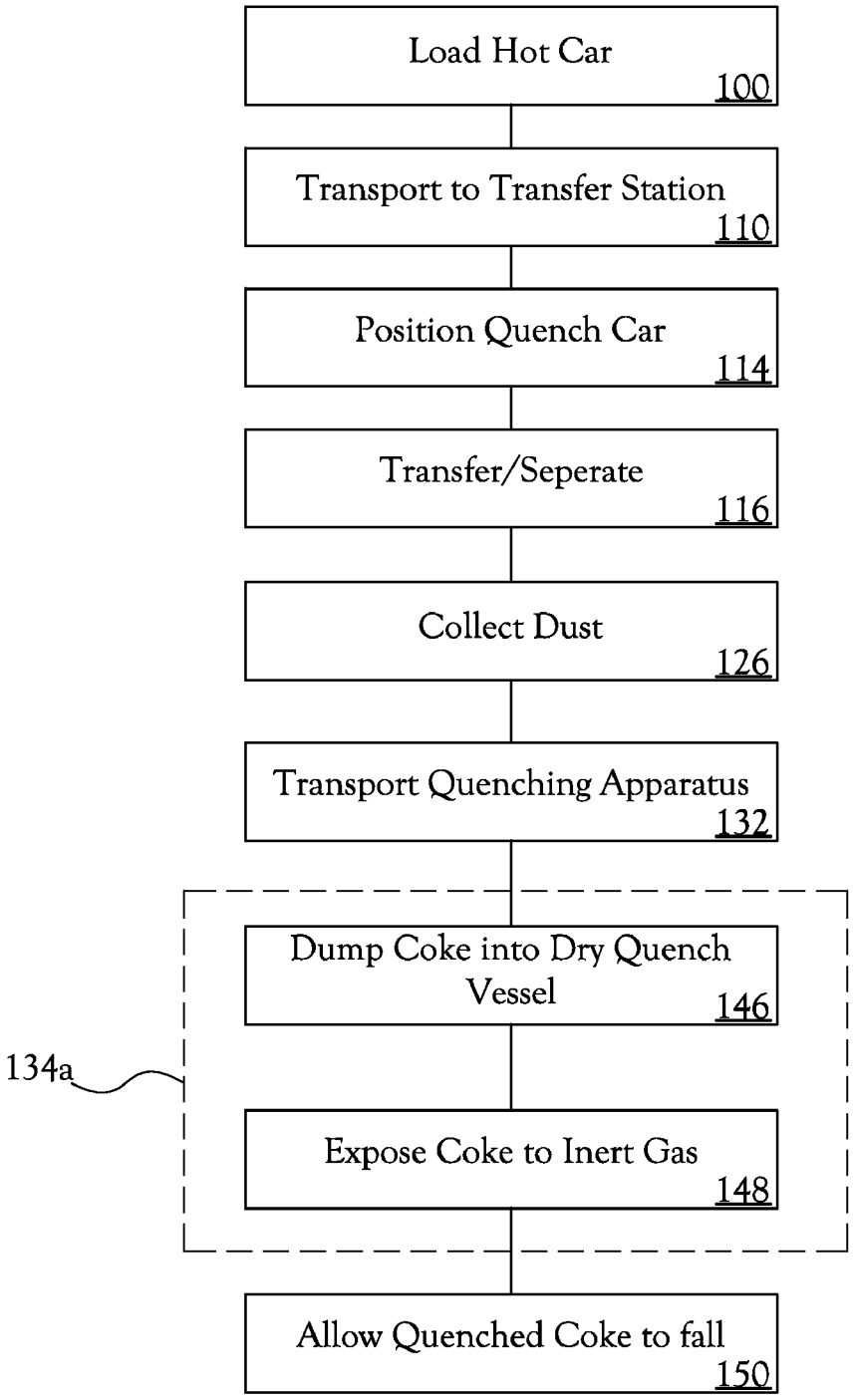
FIG. 14 is a flow diagram showing additional detail of the quenching process in another embodiment of the method invention.

FIGS. 13 and 14 illustrate two embodiments of the quenching process 134. Referring to FIG. 13, in an embodiment in which a wet quenching apparatus 24 is used, the quench car 18 is positioned 134 beneath the sprays 58 of the tower 56. A quantity of water is directed downwardly from the sprays 58 onto the hot loose bulk coke 20 in the quench car receptacle 50 sufficient to effect quenching of the coke 20. Upon quenching the coke 20, it is anticipated that at least a portion of the water evaporates, thereby separating 140 excess water from the quenched coke 20 and generating steam laden with particulates as described above. Thus, in an optional step (not shown), a portion of the steam laden with particulates is captured by the baffling system_. In one embodiment, the quantity of water applied 138 to the hot loose bulk coke 20 is selected to be a great enough quantity to quench the coke 20, yet a sufficiently small quantity such that excess water evaporates from the quenched coke or drains freely from the quench car 20, thereby avoiding buildup and entrainment of excess moisture within the quenched coke 20. Thus, it will be understood that the quantity of water selected for use in quenching the coke 20 is dependent upon the quantity of coke 20 to be quenched, as well as the specific heat and water-retention characteristics of the coke 20 to be quenched 134. In additional optional steps, following application 138 of water onto the coke 20 and subsequent removal 140 of excess water therefrom, the quench car 18 is further driven 142 along the second railway 48 to the staging area 26. Once positioned at the staging area 26, the quenched coke is unloaded 144 from the quench car 18 as described above.

FIG. 14 illustrates another embodiment in which a detachable receptacle 50*a* is used in connection with a dry quenching apparatus 24*a* to accomplish quenching 134*a* of the loose bulk coke 20. As shown in FIG. 14, following collection of dust by the dust collection system 22, the receptacle 50*a* is removed from the remainder of the quench car 18*a* and is transported 132 to a position above the receiver 70 at the upper end of the dry quench vessel 72. Once positioned above the receiver 70, the hot loose bulk coke 20 is dumped from the receptacle 50*a* into the receiver 70. Thereafter, the receptacle 50*a* is returned to the chassis and wheel structure of the quench car 18*a*. Inside the dry quench vessel 72, the hot loose bulk coke 20 is allowed to fall through a quenching chamber, in which the hot loose bulk coke 20 is exposed 148 to an inert quenching gas, such as argon or another inert gas or combination of inert gasses, thereby quenching the coke 20 with the inert gas. In the illustrated embodiment of FIG. 14, the coke is then allowed to fall 150 through a bottom opening in the dry quenching apparatus 24*a* and into the wharf 64.

From the foregoing description, it will be recognized by those skilled in the art that a method and associated apparatus for transporting and quenching a batch of coke has been provided. The method and apparatus of the present invention allows for the transfer of hot coke from a coke oven battery, separation of the hot coke, quenching of the coke, and transfer of the quenched coke to a staging area for transportation to storage or an end user. The method and apparatus of the present invention allows for a significantly reduced risk of collision of the various movable machines used in the transfer and quenching process while also minimizing the production cycle between oven quenches. Furthermore, the transfer station of the present invention allows for more economical dust collection during and after separation of the hot coke at a centralized location, thereby reducing cost associated with the dust collection process.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A method for quenching a batch of coke produced in one of a plurality of coke ovens forming a coke oven battery, said method comprising:

positioning a hot car defining a substantially planar receiving surface adjacent a coke oven of the coke oven battery;

placing a unitary cake of unquenched coke onto the hot car receiving surface;

transporting the coke laden hot car to a transfer station having a dust collection system for collecting dust proximate to the transfer station;

positioning a quenching car at the transfer station adjacent the hot car and proximate the dust collection system, the quenching car defining a receptacle having a bottom surface at an elevation below the hot car receiving surface;

dumping the unitary cake of unquenched coke into the quenching car receptacle, thereby separating the unitary cake and generating dust;

collecting a significant portion of the generated dust with the dust collection system;

transporting the coke laden quenching car to a quenching station; and quenching the coke.

2. The method of claim 1, said step of dumping the unitary cake of unquenched coke into the quenching car including dropping the unquenched coke from the hot car a distance into the quenching car sufficient to accomplish separation of the unitary cake of unquenched coke into unquenched bulk coke.

3. The method of claim 1 wherein the dust collection system comprises a dust collection hood positioned above the transfer station, the dust collection hood in fluid communication with a dust filtration device via a collection duct, said step of collecting at least a portion of the generated dust including directing dust into an interior of the dust collection hood and to the dust filtration device via the collection duct.

4. The method of claim 3, wherein said step of directing dust to the dust filtration device includes activating an impeller for directing air through the collection duct.

5. The method of claim 1, said step of quenching the coke including applying a known quantity of water to the coke.

6. The method of claim 5 wherein said known quantity of water is selected to be of sufficient quantity to quench the coke, and of limited quantity such that excess water evaporates from the quenched coke.

7. The method of claim 1, said step of transporting the quenching car and separated unquenched coke to a quenching station including positioning the quenching car beneath a support structure carrying a plurality of sprays for directing water onto the unquenched coke.

8. The method of claim 7, said step of quenching the coke including activating the sprays to direct a known quantity of water onto the coke.

9. The method of claim 1, said step of quenching the coke including dumping the coke into a dry quenching apparatus.

10. The method of claim 9 further including the step of exposing the coke to an inert gas inside the dry quenching apparatus, thereby quenching the coke.

11. The method of claim 10 further including the step of allowing the quenched coke to fall from a bottom opening in the dry quenching apparatus and into a wharf.

12. The method of claim 1 further including the step of transporting the quenched coke to a staging area.

13. A method for quenching a batch of coke produced in one of a plurality of coke ovens forming a coke oven battery, said method comprising:

transferring a unitary cake of unquenched coke from a coke oven of the coke oven battery to a hot car at a first elevation;

transporting the coke laden hot car along said first elevation to a transfer station having a dust collection system for collecting dust proximate to the transfer station;

dumping the unitary cake of unquenched coke from the hot car to a quenching car at a second elevation below said first elevation proximate the dust collection system, thereby separating the unitary cake and generating dust;

collecting the generated dust with the dust collection system;

transporting the coke laden quenching car along said second elevation to a quenching apparatus;

quenching the coke with the quenching apparatus;

transporting the coke laden quenching car along said second elevation to a staging area; and transferring the quenched coke to a third elevation at the staging area for transportation to an end user.

14. The method of claim 13, said second elevation being sufficiently below said first elevation that said step of dumping the unitary cake of unquenched coke from the hot car to a quenching car results in separating the unitary cake of unquenched coke into unquenched bulk coke, whereby said difference between said first elevation and said second elevation limits collision of said hot car with said quench car.

15. The method of claim 13, said step of quenching the coke including applying a quantity of water to the coke sufficient to quench the coke.

16. The method of claim 15, said step of quenching the coke including allowing excess water to evaporate from the quenched coke.

17. The method of claim 13, said step of transferring the unitary cake of unquenched coke from the coke oven to the hot car including covering the unitary cake of unquenched coke.

* * * * *